United States Patent [19]

Zajac

[11] 4,057,204

[45] Nov. 8, 1977

[54] TUBE FOR INNER END FEEDOUT OF FLEXIBLE MATERIAL AND PACKAGE UTILIZING THE SAME

[75] Inventor: Ronald E. Zajac, Yonkers, N.Y.

[73] Assignee: Windings, Inc., Goldens Bridge, N.Y.

[21] Appl. No.: 688,023

[22] Filed: May 19, 1976

[51] Int. Cl.[2] ..... B65H 55/02; B65H 57/12

[52] U.S. Cl. ..... 242/163; 242/146; 242/157 R; 242/171

[58] Field of Search ..... 242/163, 170, 171, 159, 242/129, 137, 137.1, 138, 146, 157 R

[56] References Cited

U.S. PATENT DOCUMENTS

| | | | |
|---|---|---|---|
| 2,634,922 | 4/1953 | Taylor, Jr. | 242/163 |
| 2,716,008 | 8/1955 | Taylor, Jr. | 242/163 |
| 2,738,145 | 3/1956 | Taylor, Jr. | 242/163 |
| 3,655,140 | 4/1972 | Gordon et al. | 242/163 X |
| 3,677,491 | 7/1972 | Gerwig | 242/163 |

*Primary Examiner*—Stanley N. Gilreath
*Attorney, Agent, or Firm*—Watson, Cole, Grindle & Watson

[57] ABSTRACT

For guiding flexible material wound in a figure-8 package with inner end feedout, a coil is enclosed in a container with walls of corrugated cardboard. The payout of the material is guided by a tube having a flange adjacent the outer end, and two outwardly extending projections between the flange and the outer end, leaving a space therebetween. The inner edges of the projections are slanted in opposite directions. The tube is inserted into a coil, which is then inserted into a container formed of corrugated material. The corrugated material has an opening equal in diameter to the diameter of the tube and notches on either side of such opening extending in the direction of the corrugations. The outer end of the tube is brought through this opening, with the projections extending through the notches, and is then turned by 90°. The thickness of the cardboard is slightly less than the space between the projections and the flange. Turning the tube causes the notches to ride up on the wall and to dig into it, so as to prevent accidental turning of the tube to an unlocked position. The projections rest against uninterrupted corrugations in the wall of the container.

3 Claims, 4 Drawing Figures

TUBE FOR INNER END FEEDOUT OF FLEXIBLE MATERIAL AND PACKAGE UTILIZING THE SAME

BACKGROUND OF THE INVENTION

1. Field of the Invention

The invention relates to a tube for paying out material wound in a figure-8 coil with inner end feed out, and to a package utilizing such a tube.

2. The Prior Art

A tube has been used in packages of this type which has a flange and four projections at the free end of the tube spaced slightly from the flange by a distance substantially equal to the thickness of the packaging material. After the coil is inserted into the package, the end of the tube is brought out through an opening in the wall of the package having four notches therein to receive the projections and turned by 45°. Such a tube does not lock securely in position, and when subjected to vibration during transportation is likely to turn and lose its proper hold on the box. Additionally, the cutting of the corrugated wall transversely to the corrugations so weakens the area of the box where the tube is located that there is danger that the tube may be pushed into the box if it is engaged by some outside object, thus interfering with the proper feed-out of the material.

SUMMARY OF THE INVENTION

According to the invention, such a tube is provided with only two projections on opposite sides. These projections have sloping lower walls facing the flange, and the space between the inner edges of these walls is less than the wall thickness of the package. When this is inserted and is turned about by 90°, the inclined lower surfaces of the projections ride on the box material and grip into it, which substantially prevents any accidental turning of the tube to an improper position.

Additionally, the notches in the wall which receive the projections extend parallel to the corrugations of the wall. In this way, those portions of the box on which the projections engage when the tube is turned to its operative position are not weakened and there is much less danger that the tube will be pushed into the box.

DESCRIPTION OF THE PREFERRED EMBODIMENTS

Figure 1:
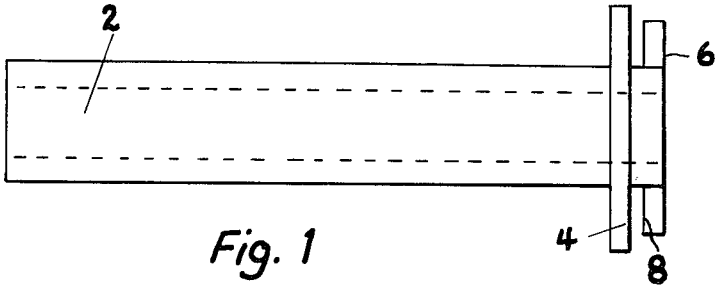
FIG. 1 shows in side elevation a tube embodying the invention.
Figure 2:
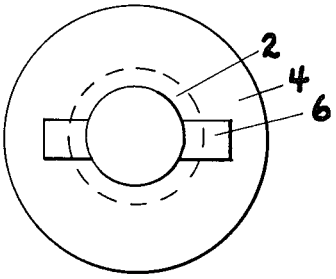
FIG. 2 is an end view from the right-hand side of FIG. 1.
Figure 3:
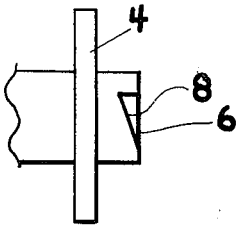
FIG. 3 is a side elevation at the right angles of the tube of FIG. 1.

Referring to FIG. 1, there is a hollow tube 2 which has near one end a flange 4. At the end of the tube beyond the flange 4 are two projections 6, these projections having inner sloping surfaces 8, which slope oppositely on opposite sides.

Figure 4:
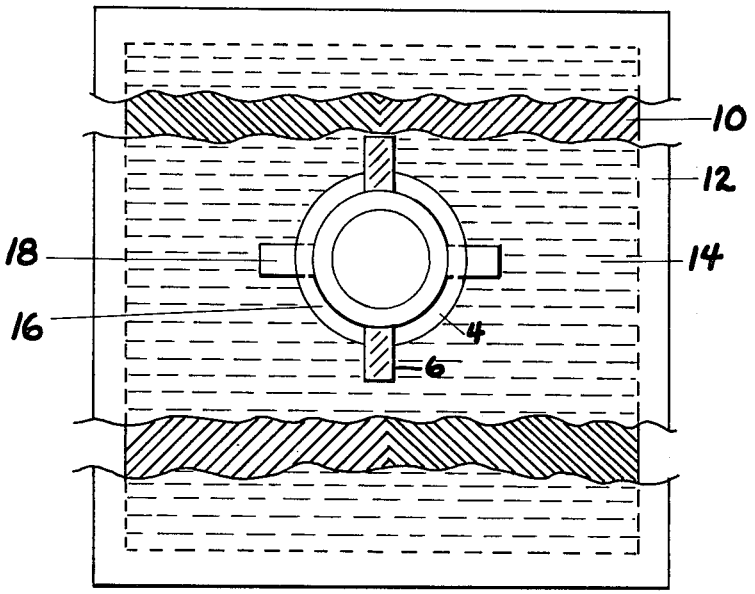
FIG. 4 shows the tube applied in a box or container.

FIG. 4 shows a coil 10 of flexible material, wound in a package such as for example that shown in Taylor U.S. Pat. No. 3,178,130. The coil is contained in a container 12 having a wall made of cardboard and provided with corrugations 14. The wall has a hole 16 of the size of the tube and two notches 18 of the size of the projections 6, and running in the direction of the corrugations 14.

As will be clear from this figure, when the coil is inserted inside the package and the projections are passed out through the notches 18 and the tube turned 90°, the projections 6 will rest on an uninterrupted section of the corrugations 14, so that the box is not weakened and the danger of having the tube pushed into the package is greatly reduced.

I claim:

1. A tube for insertion into a coil of material wound in a plurality of figure-8s for inner end feedout having a flange adjacent one end thereof and a pair of projections spaced from the flange and having their inner surfaces tapered.

2. A package, comprising:

a container including at least one wall formed of corrugated cardboard and a hole having a pair of notches formed therein, a coil of flexible material wound in a series of figure 8s with crossovers progressing around the winding and having a central core space with a radial opening extending to said central core space, said radial opening being aligned with said hole, a tube as claimed in claim 1 arranged in said radial opening with the flanged end thereof extending through said hole and said pair of projections engaging the outer surface of said wall.

3. A package as in claim 2 wherein said notches are diametrically disposed and extend in the direction of the corrugations of said wall, said pair of projections are diametrically disposed, and extend substantially perpendicular to the direction of the corrugations of the said wall to engage an uninterrupted section of said corrugations.

* * * * *